United States Patent [19]

Caillouet

[11] 4,416,405

[45] Nov. 22, 1983

[54] CAMERA BODY TIE DOWN AND QUICK RELEASE DEVICE

[76] Inventor: Jerome P. Caillouet, 213 Myrtle Grove Dr., Donaldsonville, La. 70346

[21] Appl. No.: 399,893

[22] Filed: Jul. 19, 1982

[51] Int. Cl.[3] ..... A45F 5/00

[52] U.S. Cl. ..... 224/257; 224/208; 224/215; 224/901; 224/908

[58] Field of Search ..... 224/257, 215, 216, 208, 224/262, 901, 908, 909; 354/293

[56] References Cited

U.S. PATENT DOCUMENTS

| | | | |
|---|---|---|---|
| 3,305,148 | 2/1967 | Zimmerman | 224/257 X |
| 3,507,424 | 4/1970 | Burkins | 224/5 |
| 3,884,403 | 5/1975 | Brewer | 224/5 |
| 3,998,367 | 12/1976 | Harding | 224/208 |
| 4,033,488 | 7/1977 | Brewer | 224/215 X |
| 4,168,022 | 9/1979 | Brewer | 224/257 |
| 4,320,863 | 3/1982 | Lyer | 224/259 |
| 4,328,917 | 5/1982 | Reeberg | 224/257 X |

*Primary Examiner*—Steven M. Pollard
*Attorney, Agent, or Firm*—Wilkinson, Mawhinney & Theibault

[57] ABSTRACT

The present disclosure is directed for use with a camera having an around the neck support strap connected to rings at each end of the camera; a camera tie down-/quick release strap is adapted to hold the camera against the chest of the wearer in a carrying position and which permits quick selective eye level positioning of the camera in a shooting position without detaching the camera from being secured to the body. It is provided with a U-shaped strap having camera attaching means at each of its ends and being adapted to pass over and beneath the camera without interferring with or blocking the camera lens opening. A body tie down quick release tail strap is carried by the loop portion of said U-shaped strap foldable back upon itself, and means for attaching and releaseing the foldable back upon itself tail portion of the quick release strap provides the quick release and the body tie down.

6 Claims, 4 Drawing Figures

CAMERA BODY TIE DOWN AND QUICK RELEASE DEVICE

SUMMARY OF THE INVENTION

The primary object of the invention is to provide a comfortable less conspicuous structure for use with a camera which will permit the photographer to release the camera from body attachment quicker when preparing to shoot which still maintains contact between the camera and body of the user and which is simple in construction, inexpensive to manufacture and comfortable in wear and use and which permits the protective cover case of the camera to be used with the tie down device without defacing either the external case or camera.

THE PRIOR ART

Numerous devices have been advanced for coupling the photographer with his camera many of which teach body harnesses which are complicated and uncomfortable to wear. The closest prior art known to me at the filing of this application is as follows:

U.S. Pat. No. 3,507,424, Burkins, 1970
U.S. Pat. No. 3,884,402, Brewer, 1975
U.S. Pat. No. 4,320,863, Lyer, 1982

DESCRIPTION OF THE PREFERRED EMBODIMENT

Figure 3:
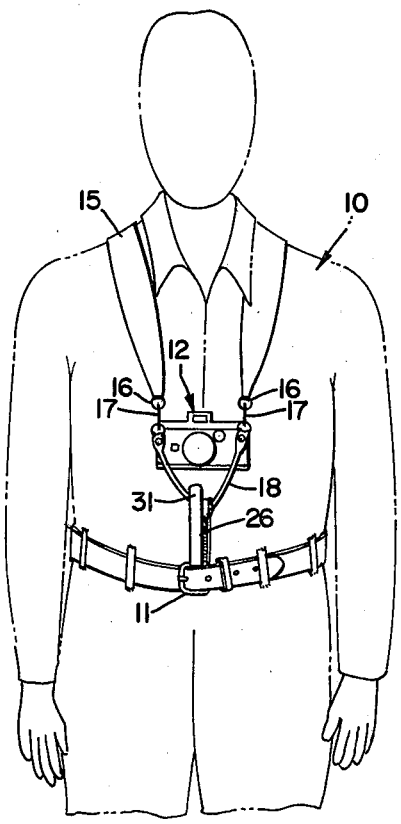
FIG. 3 is a front view of a photographer wearing a camera with the camera tied down with the device of FIG. 2.
Figure 4:
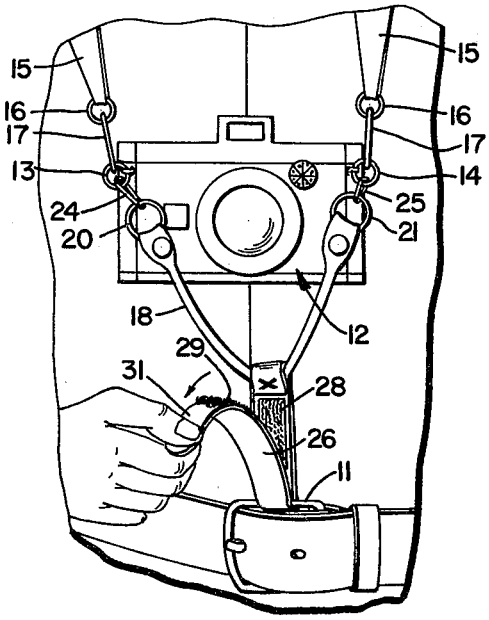
FIG. 4 is a fragmentary perspective view taken at an enlarged scale of FIG. 3 with the photographer actuating the quick release of the tie down preparatory to use of the camera.

Referring now to FIG. 3, 10 indicates a photographer wearing trousers held up by a conventional belt having an open frame belt buckle 11. As shown in FIGS. 3 and 4, the photographer has a camera 12 having attaching rings 13, 14 secured thereto. The camera 12 hangs from a neck strap 15 which has rings 16 and attaching hooks 17. The hooks 17 attach to the rings 13, 14. This constitutes the background in which the present invention finds application.

Figure 1:
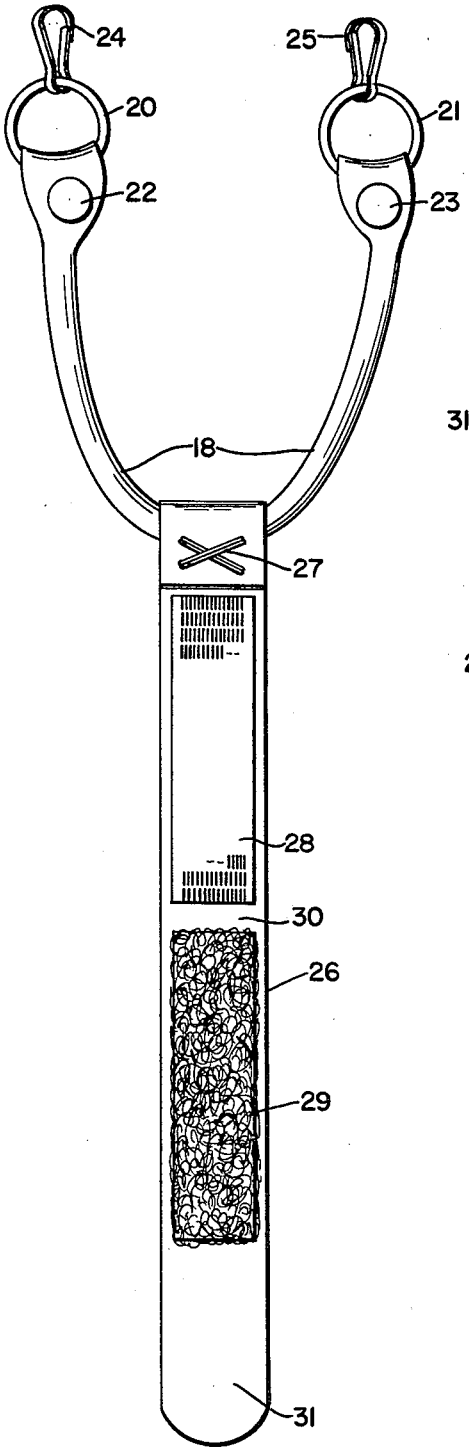
FIG. 1 is a front elevational view of the camera body tie down and quick release device of the present invention with the tie down tail in its fully extended condition.
Figure 2:
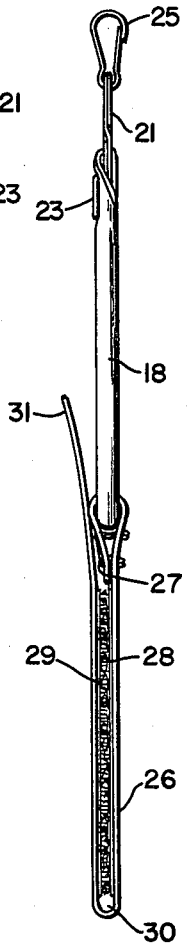
FIG. 2 is a side elevational view of the device of FIG. 1 with the tie down tail in the tie down condition.

The problem at hand is to secure the camera 12 to the photographer 10 so that it does not move around incident to body movement so that it could bang into objects and become damaged incident to relative movement between the body and the camera. The camera must be capable of instant detachment from its body anchored state to permit instant selective eye level positioning of the camera to take a photograph in one swift movement. Referring now to FIGS. 1 and 2 the camera tie down and quick release strap is shown as comprising a U-shaped strap or tube 18 having rings 20, 21 secured to the ends of the strap by rivets 22, 23 or stitching. Clasps 24, 25 are carried by rings 20, 21 for attachment to the camera rings 13, 14. The strap 18 has a leg or tie down tail 26 which is attached to the U-shaped strap 18 by stitching or rivets 27. Located on the same side of the tie down tail 26 are two strips of Velcro 28, 29 having a space 30 therebetween. The free end of the tail 26 has a tongue 31 for grasping the tail for either attachment or quick release.

In use the camera 12 is placed about the neck, FIG. 3, the hooks 24, 25 are attached to the camera rings 13, 14 as shown in FIG. 4. The tongue 31 is passed through the belt buckle frame 11 and the Velcro strip 29 is pressed into locking engagement with the strip 28. The camera is now secured to the photographer and will move as one with his body.

When it is desired to shoot a picture quickly at which time the camera must be moved to eye level for focusing and framing of the subject to be photographed the photographer will grasp the tongue 31 and pull the Velcro strips 28, 29 apart which will free the tie down and permit the camera to be instantly raised to the photographing position. At all times the camera 12 is secured to the person of the photographer.

The tie down will hold the camera snuggly against the body and eliminate all camera swing and movement relative to the body. The camera can be moved from a tie down position to the eye position for focusing and shooting in one swift movement, all without body encircling cumbersome harnesses described in the above identified patents.

The tie down can be used with or without the external protective camera case in a manner not requiring defacing of either the camera or case.

What is claimed:

1. For use with a camera having an around the neck support strap connected to rings at each end of the camera; a camera tie down/quick release strap adapted to hold the camera against the chest of the wearer in a carrying position and permitting quick selective eye level positioning of the camera in a shooting position without detaching the camera from being secured to the body, comprising:

(a) a U-shaped strap means having camera attaching means at each of its ends and being adapted to pass over and beneath the camera without interfering with or blocking the camera lens opening, (b) a body tie down quick release strap carried by the loop portion of said U-shaped strap foldable back upon itself, and (c) means for attaching and releasing the foldable back upon itself portion of the quick release strap for providing the quick release and the body tie down.

2. A camera tie down/quick release strap as claimed in claim 1 wherein the camera attaching means at each end of the U-shaped strap means are rings carrying snap hooks which hooks are adapted to lock to the camera case rings at each end of the camera.

3. A camera tie down/quick release strap as claimed in claim 1 wherein said body tie down quick release strap has a folded over looped end adapted to pass over the U-shaped strap means and a tail portion adapted to be passed through the top portion of a belt buckle of the wearer and attached back upon itself.

4. A camera tie down/quick release strap as claimed in claim 1 wherein the means for attaching and releasing the foldable tail portion are strips of Velcro on the opposed portions of the tail.

5. For use with a photographer wearing trousers supported by a belt having a central buckle, a camera having an around the neck support strap connected to rings at each end of the camera; a camera tie down-/quick release strap adapted to hold the camera against the chest of the wearer comprising:

(a) a Y-shaped strap having upwardly divergent legs and a central downwardly depending tail portion, (b) camera attaching means at the upper free ends of the divergent legs of said Y-shaped strap, (c) and means carried by said tail portion of the Y-shaped strap for causing said tail when passed through the belt buckle of the wearer to attach upon itself to provide a quick release to permit selective eye level positioning of the camera in a shooting position without detaching the camera from being secured to the body of the wearer.

6. A camera tie down/quick release strap as claimed in claim 5 wherein the quick release on the tail portion when folded back upon itself are strips of Velcro opposing each other when the tail is folded back upon itself, said tail terminating in a pull tongue to effectuate quick release.

* * * * *